US012765617B2

(12) United States Patent
Abadie

(10) Patent No.: US 12,765,617 B2
(45) Date of Patent: Oct. 20, 2026

(54) UNDERGARMENT PROTECTIVE AGAINST CARRIED-WEAPON DISCOMFORT AND INJURY

(71) Applicant: Tyler Abadie, Baton Rouge, LA (US)

(72) Inventor: Tyler Abadie, Baton Rouge, LA (US)

( * ) Notice: Subject to any disclaimer, the term of this patent is extended or adjusted under 35 U.S.C. 154(b) by 0 days.

(21) Appl. No.: 18/142,420

(22) Filed: May 2, 2023

(65) Prior Publication Data

US 2024/0365891 A1 Nov. 7, 2024

(51) Int. Cl.

| | |
|---|---|
| ***F41C 33/04*** | (2006.01) |
| ***A41D 13/00*** | (2006.01) |
| ***A41D 27/20*** | (2006.01) |
| ***F41C 33/02*** | (2006.01) |

(52) U.S. Cl.

CPC ..... *A41D 13/0012* (2013.01); *F41C 33/0209* (2013.01); *F41C 33/046* (2013.01); *A41D 27/207* (2013.01)

(58) Field of Classification Search

CPC .. A41D 13/0012; A41D 27/205; A41D 27/02; A41D 27/201; F41C 33/046; F41C 33/08; F41C 33/0209; F41C 33/0218; A41B 9/02; A41B 9/001

USPC ..... 224/587; 2/238, 400, 267, 78.1

See application file for complete search history.

(56) References Cited

U.S. PATENT DOCUMENTS

| | | | | |
|---|---|---|---|---|
| 3,204,253 | A * | 9/1965 | Sato | A41D 1/06 2/237 |
| 5,497,511 | A | 3/1996 | Zade | |
| 5,584,072 | A | 12/1996 | Kim et al. | |
| 5,649,328 | A * | 7/1997 | Martin | A41D 13/0537 2/238 |
| 5,722,093 | A | 3/1998 | Andresen | |
| 5,909,834 | A | 6/1999 | Parrott, III | |
| 6,408,446 | B1 | 6/2002 | Carrington | |
| 6,532,599 | B1 | 3/2003 | Dugan | |
| 7,000,261 | B1 * | 2/2006 | Loffredo | A61F 5/449 2/400 |
| 8,522,367 | B2 | 9/2013 | French et al. | |
| 8,528,114 | B2 * | 9/2013 | Baiany | A41D 7/005 2/238 |
| 8,856,970 | B2 | 10/2014 | French | |
| 8,980,412 | B2 | 3/2015 | Kim | |
| 9,291,426 | B2 | 3/2016 | Györfi | |
| 9,513,084 | B1 * | 12/2016 | Baugh | F41C 33/0209 |
| 2007/0250980 | A1 | 11/2007 | Pellerin | |

(Continued)

FOREIGN PATENT DOCUMENTS

| | | |
|---|---|---|
| BR | 2020180000816 U2 | 7/2019 |

*Primary Examiner* — Alissa L Hoey
*Assistant Examiner* — Akwokwo Olabisi Redhead

(57) ABSTRACT

An undergarment protective against carried-weapon discomfort and injury for use with carrying or holstering of a hand weapon such as a handgun, a knife, or an electroshock weapon, providing an undergarment shell, a waistband attached to the undergarment shell, and a padded lining attached to the undergarment shell and waistband. In a holstering embodiment, the undergarment shell and padded lining form an enclosed space or pocket, with an access opening in the undergarment shell. The undergarment protective against carried-weapon discomfort and injury is made of materials and with construction methods allowing frequent and easy laundering, and providing a low cost to allow a person to obtain several units.

19 Claims, 3 Drawing Sheets

(56) References Cited

U.S. PATENT DOCUMENTS

| | | | | |
|---|---|---|---|---|
| 2013/0283494 | A1* | 10/2013 | Vaughn | A41D 1/14 2/69 |
| 2014/0021235 | A1* | 1/2014 | Hunter | F41C 33/02 224/587 |
| 2015/0089708 | A1 | 4/2015 | Trevino | |
| 2015/0122861 | A1* | 5/2015 | Adams | F41C 33/0218 224/587 |
| 2015/0144673 | A1* | 5/2015 | Dahl | F41C 33/048 224/587 |
| 2015/0359273 | A1* | 12/2015 | Olson | A41D 13/0012 2/250 |

* cited by examiner

UNDERGARMENT PROTECTIVE AGAINST CARRIED-WEAPON DISCOMFORT AND INJURY

BACKGROUND OF THE INVENTION

This invention provides an undergarment protective against carried-weapon discomfort and injury for use with carrying or holstering of a hand weapon such as a handgun, a knife, or an electroshock weapon.

Some persons have a need to holster or carry a weapon such as a handgun, a knife, a chemical mace, or an electric shock device on their person in a non-obvious or concealed location that allows the person easy access to the weapon but prevents easy access to the weapon by other persons.

Existing devices or garments meant for holstering a weapon have a number of drawbacks such as expense, complexity, discomfort, too much difficulty in retrieving the weapon by the user, or too little protection against access to the weapon by others. Many existing garments cannot be easily cleaned using usual laundry methods, which becomes a significant problem with existing garments meant to be used as undergarments, which should ideally be cleaned after each day's wearing, and where having at least a week's worth of such undergarments is desirable. Many existing garments and wearable devices cannot be frequently and easily cleaned without a risk of damage either to the garment or to the washing machines. Many existing garments and wearable devices require special handling for any cleaning. And many existing garments and wearable devices are too expensive for some persons to be able to own several units.

What is needed is an undergarment protective against carried-weapon discomfort and injury durable enough to be regularly washed along with other undergarments, and inexpensive enough to allow a person to own several interchangeable units of the undergarment protective against carried-weapon discomfort and injury.

U.S. Pat. No. 8,980,412 for a "Resilient Pad Composite and Process for Making Same," issued on Mar. 17, 2015 to assignee Applied FT Composite Solutions Inc., provides for a composite pad structure that includes a substrate bonded to a plurality of discrete, spaced-apart, resilient elements engaged to at least one reinforcing structure.

Brazilian Publication No. 202018000081 for "Underwear Clothing," published on Jul. 16, 2019 by inventor Ícaro Jorge Alves De Almeida, discloses underwear designed to facilitate the carrying of guns by police officers and other persons authorized to carry firearms.

U.S. Pat. No. 6,408,446 for a "Protective Garment for the Hip Area," issued on Jun. 25, 2002 to assignee Plum Enterprises, Inc., provides for a pair of protective undershorts for absorbing shock and protecting the hips of the wearer against the shock. The undershorts include a pair of large pockets on the inside over the hips, and protective pads in the pockets. Each of the pads extends round approximately ⅓ of the circumference of the wearer. The pads are of a rounded shape, with the upper edge slightly concave, and extend vertically from the hip-bone to below the enarthrodial joint of the hip. The pads are ⅛" thick, and comprise closed-cell foam material with a density of 10.0 to 13.0 lbs/cu. ft., a compression resistance of 9.0 to 13.0 psi, and a tensile strength of at least 150 psi.

U.S. Pat. No. 5,722,093 for a "Hip Protector," issued on Mar. 3, 1998 to assignee Sahva A/S, provides for a hip protector comprising a dome-shaped element having a concave side adapted to be attached to the hip region of a human body. The hip protector is formed in the shape of a curved shell made of foamed rigid plastic material. The protector can be attached to the inner side of an underwear, such as an inner pocket, for correct positioning.

U.S. Pat. No. 5,497,511 for "Protective Pants for the Hip," issued on Mar. 12, 1996 to inventor Isimail Y. Zade, provides for pants for aiding and preventing injury to the hip and upper femur. The pants are made from resilient material having body cushioning properties and four pockets. The pockets are positioned with a pocket on each side of the back and one adjacent hips on each side. Pockets are positioned to cover the hips and upper femur area of the wearer. A pair of rigid pads are placed within the pockets on each side of the back and a second pair of rigid pads are provided for placement within the pockets on each side adjacent to the hip. The pockets located on the back are fitted with reinforcements such as plastic spaced apart and running horizontally therein to allow for flexibility of movement about a horizontal axis. Pads on the side of the hip are fitted with reinforcement means spaced apart and running vertically to allow for flexibility and movement about a vertical axis.

U.S. Pat. No. 6,532,599 for "Athletic Shorts with Removable Contoured Pads," issued on Mar. 18, 2003 to inventor Anthony J. Dugan, provides for a pair of athletic shorts with removable contoured pads. The elastic shorts have thigh, hip and tailbone pockets permanently affixed to the main shell of the shorts. Each of the pockets has upper flaps, which are fastened to the lower portion of the pocket by hook-and-loop fasteners. The pad itself is a semi-flexible cushioned type of pad having a serrated configuration such that only portions of the pad actually come in contact with the athlete's body. These pads have peaks and valleys such that they are fully compressed only during a fall or a collision, remaining only in partial contact with the athlete's body at other times. The pads may be removed, washed, and replaced easily because they are not permanently sewn or attached to the main shell of the athletic shorts.

U.S. Pat. No. 5,584,072 for a "Hip Protector," issued on Dec. 17, 1996 to inventors Bill H. Kim et al., provides for a hip protector using a matching pair of hip protector holsters interconnectable to form a waist encircling belt from which a pair of protective pad pockets are pivotally suspended over the patient's hips and secured in place by leg encircling straps. The hip protector is light weight and flexible for use under clothing and does not interfere with restroom activities. Each holster is identical and has a wide waist size adjustment range to minimize costs and inventory problems. The pads include impact absorbing base pads on which are positioned semi-rigid shells to distribute impact energy across the pad. The waist and leg encircling belts are secured by hook and loop fastening fabric for convenience and adjustability, and may be provided with an alternative hook and loop fastening fabric to service a substantially different range of leg sizes. The waist encircling belt may be locked with cable ties, a locking strap, or a locking buckle to ensure compliance. The locking belt prevents casual removal of the belt by patients that may not be counted on to continue compliance and may be used for the same purposes with other medical appliances.

U.S. Pat. No. 9,513,084 for an "Undergarment with Firearm Holster," issued on Dec. 6, 2016 to inventor Randy G. Baugh, provides for an undergarment that includes a holster for holding a firearm therein. The holster includes a pouch defined by a space between an inner layer and an outer layer of fabric. The inner and outer layers are joined, such as by stitching at forward and rearward edges, but kept open at an open top and an open bottom. The open bottom is smaller than the open top to allow a barrel of a pistol to pass therethrough but to hold the remainder of the pistol within the pouch. A semi-rigid trigger guard plate can also be provided adjacent to the outer layer. A magazine carrier is optionally also provided as a pouch between an outer panel and an inner panel coupled to the undergarment at a waistband thereof. Both the holster and the optional magazine carrier include padding on inner sides thereof, which padding extends up above the waistband of the underwear.

US Publication No. 2015/0089708 for a "Clothing System with Concealed Weapons Compartment," published on Apr. 2, 2015 by inventor Brandon Keith Trevino, discloses a clothing system with a concealment pocket for concealing a weapon or other items. The concealment pocket includes internal stitching which may follow the outline of a weapon, such as a handgun. The internal stitching maintains the orientation of the handgun when placed in the concealment pocket. The concealment pocket is located on the clothing system such that when a weapon or other item is inserted in the pocket, the outline of the weapon is not visible, and the pocket retains the weapon despite movements by the clothing system wearer. The concealment pocket is constructed of materials that offer high strength, resist abrasion, and reduce friction with an inserted weapon allowing for the weapon to be removed with little resistance. Padding attached to the concealment pocket provides a cushioning layer to the clothing system wearer. A cargo pocket may be located in proximity to the concealment pocket. The cargo pocket placement aids in disguising the concealment pocket and its contents. The seams of the clothing system may be positioned to allow for the placement of the concealment pocket. Additional pockets may be provided that may include internal stitching to storage of other items, including weapons. The pocket has sufficient opening width to allow for rapid placement and removal of various sizes of handguns and other equipment without stressing the fabric and has sufficient depth to retain articles placed in the pockets through the wearer's full range of motion.

U.S. Pat. No. 5,909,834 for a "Concealed Carry Holster," issued on Jun. 8, 1999 to inventor Charles W. Parrott, III, provides for a handgun holster for concealment under a user's clothing. The holster includes a forward panel formed of multiple forward sheets placed face to face and having forward sheet upper edges cuffed toward each other and sewn together with a forward stitched cuff interconnection seam so that the forward sheet upper edges are contained between the forward sheets; a rearward panel formed of multiple rearward sheets placed face to face and having rearward sheet upper edges cuffed toward each other and sewn together with a rearward stitched cuff interconnection seam so that the rearward sheet upper edges are contained between the rearward sheets; so that a gun is not caught on the forward and rearward sheet upper edges; and a strap from the forward and rearward panels rearwardly and defining a loop for encircling and thereby engaging a user waist. The handgun holster preferably additionally includes a piece of batting extending into the forward cuff, the stitched cuff interconnection seam passing through the batting and thereby forming a French seam at the forward panel upper edge.

U.S. Pat. No. 8,522,367 for a "Garment Pocket for Carrying an Object in a Concealed State," issued on Sep. 3, 2013 to assignee CCW Breakaways LLC, provides for a pocket for a garment. The pocket comprises a first portion and a second portion connected to the first portion to form a partially-enclosed space. The partially-enclosed space comprises a region defined by a first line corresponding substantially to a line of flexion of a hip joint of a wearer of the garment, a second line corresponding substantially to a centerline of a thigh of a wearer of the garment, and a third line corresponding approximately to an inseam of a wearer of the garment. The region is configured and disposed to substantially conceal an object (e.g., a handgun magazine) retained in the region from a person viewing the garment. The pocket further comprises a retaining device disposed in the region. The retaining device is configured and disposed to hold the object in a fixed position in the region.

U.S. Pat. No. 8,856,970 for a "Garment Pocket for Carrying an Object in a Concealed State," issued on Oct. 14, 2014 to assignee CCW Breakaways LLC, provides for a pocket for a garment. The pocket comprises a first layer and a second layer, which is attached to the first layer to form a partially enclosed space. The partially enclosed space comprises a region defined by a first line corresponding substantially to a line of flexion of a hip joint of a wearer of the garment and a second line corresponding substantially to a centerline of a thigh of a wearer of the garment. The region is configured and disposed to substantially conceal an object stored in the region from a person viewing the garment.

U.S. Pat. No. 9,291,426 for a "Carrying Device for Wearing a Holster Component Inside the Trouser-Leg," issued on Mar. 22, 2016 to inventor Tamás Györfi, provides for a carrying device for wearing a holster component, preferably for the concealed placement of law-enforcement equipment placed in a holster component inside the trouser-leg, wherein a slit opening is formed in the trousers to provide access to the equipment, such a way that inside the trouser-leg, positioned in a way to be accessible through the slit opening, there is a carrying component suitable for wearing the holster component, which is fastened to the trousers' waistband, at a given distance from it, by holding components, furthermore the carrying component is equipped with thigh-fasteners, and there are joining components placed on the holster component and on the carrying component for the purpose of joining together the holster component and the carrying component.

US Publication No. 2015/0122861 for a "Garment with Compression Concealment Compartment," published on May 7, 2015 by inventors Carol D. Adams et al., discloses a compression concealment compartment for concealing an article between a portion of a garment and a body of a wearer, and the compartment includes a concealment panel having a peripheral edge. The concealment panel has at least two layers and includes an outer panel constructed of a first material having at least one of a weight and a drape configured to reduce a silhouette of an article and having a peripheral edge. An inner panel is constructed of a second material and is joined to the outer panel along a portion of the peripheral edge, wherein together they define the peripheral edge of the concealment panel. A liner has an outer surface in opposed relationship with the inner surface of the inner panel, and an inner surface for facing the body of the wearer. The liner is joined to the concealment panel along a portion of the peripheral edge to define the compartment having an interior space for containing the article.

US Publication No. 2007/0250980 for a "Maximum Concealment Holster and Shorts Combination," published on Nov. 1, 2007 by inventor Timothy Pellerin, discloses a concealed carry holster for handguns. The holster comprises a pair of shorts comprising a lightweight material such as spandex and having a waist opening and two leg openings. The shorts comprise a waistband around the waist opening. A drawstring may be provided in the waistband for providing additional support in securing the holster and firearm to the body of the wearer. Non-slip material may be provided around each leg opening. This non-slip material may include elastic material. A holster piece attaches to the exterior of the shorts in the crotch region. In one embodiment, the holster piece is formed in the shape of an uppercase "A." In this embodiment, a lower region of the holster piece is sewn into the shorts using industrial strength stitching. A fastening means such as hook-and-loop fasteners, secures the upper region of the holster piece to the shorts. The holster piece is arranged such that a user can pass his hand down his pants or exterior shorts to easily retrieve a handgun stowed within the holster.

SUMMARY OF THE INVENTION

This invention provides an undergarment protective against carried-weapon discomfort and injury for use with carrying or holstering of a hand weapon such as a handgun, a knife, or an electroshock weapon.

The undergarment protective against carried-weapon discomfort and injury provides an undergarment shell, a waistband attached to the undergarment shell, and a padded lining attached to the undergarment shell and waistband optionally with the padded lining forming an enclosed space or pocket and an access opening in the undergarment shell.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
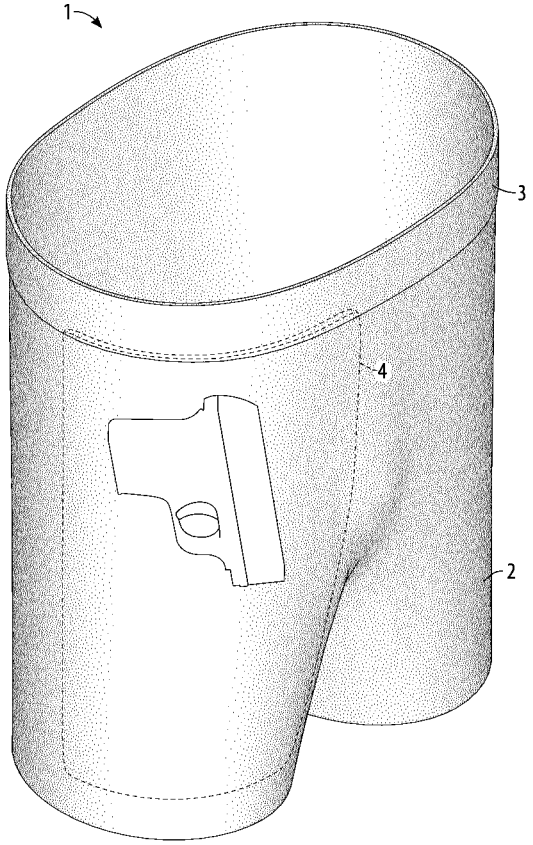
FIG. 1 is front perspective view of the undergarment protective against carried-weapon discomfort and injury of the invention.
Figure 2:
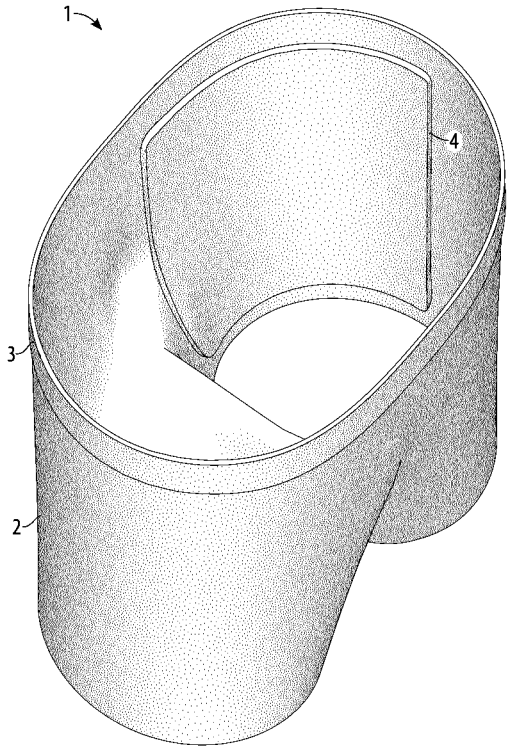
FIG. 2 is a rear perspective view of the undergarment protective against carried-weapon discomfort and injury of the invention.

Referring to FIG. 1 and FIG. 2, the undergarment protective against carried-weapon discomfort and injury 1 of the invention provides an undergarment shell 2, a waistband 3 attached to the undergarment shell 2, and a padded lining 4 attached to the undergarment shell 2 and the waistband 3. The undergarment protective against carried-weapon discomfort and injury 1 is made of materials and with construction methods allowing frequent and easy laundering, and providing a low cost to allow a person to obtain several units. The undergarment protective against carried-weapon discomfort and injury 1 provides protection against discomfort and injury from a weapon such as a handgun, a knife, or an electroshock weapon carried at the waist of the user either outside or inside of an outer garment. The illustrated embodiment provides for weapons to be accessed using the right hand. Another contemplated embodiment provides for weapons to be accessed using the left hand, with a simple mirroring of the illustrated embodiment.

Figure 3:
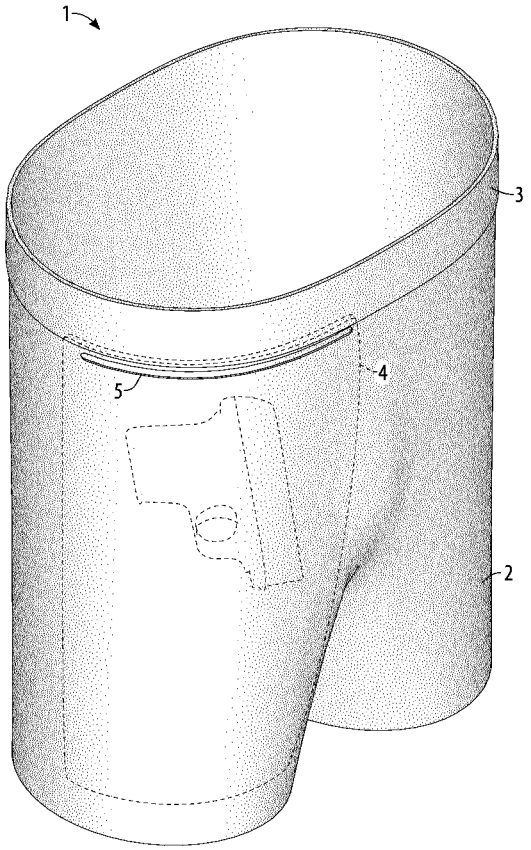
FIG. 3 is a front perspective view of an embodiment of the undergarment protective against carried-weapon discomfort and injury of the invention having an access opening.

Referring additionally to FIG. 3, a holstering embodiment of the undergarment protective against carried-weapon discomfort and injury 1 additionally provides for the holstering of a weapon such as the handgun illustrated in the enclosed space or pocket between the undergarment shell 2 and padded lining 4, with access to the weapon provided through an access opening 5.

The undergarment shell 2 is made of one or more textile fabrics suitable for use as an undergarment, including woven and non-woven fabrics and fabric blends which are not irritating to human skin, which provide at least some permeability to air and water vapor, and which can be laundered frequently, simply, and inexpensively. Textile fabrics of natural fibers such as cotton or synthetic fibers such as polyester, or blends, are appropriate. A microfiber fabric made variously of polyesters, polyamides, or combinations of polyester, polyamide, and polypropylene is particularly appropriate. In a preferred embodiment, the undergarment shell 2 is made of a microfiber textile fabric. The undergarment shell 2 is open at a top end to accommodate the lower torso of the user, and bifurcates into two openings at the bottom end to accommodate the upper legs of the user. The undergarment shell 2 has an outside surface and an inside surface, and has a forward portion and rearward portion. Optionally, the undergarment shell 2 can have other features such as an opening or flap, or reinforcing or decorative elements such as mesh, piping, cord, or tape.

The waistband 3 is attached to the top end of the undergarment shell 2 and is meant to fit around the waist of the user and to support the undergarment shell 2 and prevent unwanted downward slippage. The waistband 3 can be made of an elastic or stretchable material, or can incorporate such an elastic or stretchable material, such as braided, knitted, or woven elastic or a stretch fabric such as spandex. The waistband 3 can be made slightly smaller than the intended size during use, so that during use the waistband 3 is slightly stretched and exerts a slight force on the user's waist. The material used for the waistband 3, and the method of attaching the waistband 3 to the undergarment shell 2, such as sewing, should allow for frequent and easy laundering.

The padded lining 4 is attached to the inside of the undergarment shell 2 in a location that is substantially one quadrant of the forward portion of the undergarment shell 2, as shown. The padded lining 4 can also be attached to the waistband 3, so that the waistband 3 supports the padded lining 4 in addition to supporting the undergarment shell 2. Such additional attachment of the padded lining 4 to the waistband 3 might be useful in the holstering embodiment of the undergarment protective against carried-weapon discomfort and injury 1 in order to better support the weight of the weapon. The padded lining 4 can be attached to the undergarment shell 2 and waistband 3 by sewing the materials together. Other methods of attachment, such as heat or solvent welding, might be used with suitable textile fabrics. The padded lining 4 can be made from a single layer of textile fabric or from two or more layers of textile fabrics. In a preferred embodiment, a layer of neoprene foam is placed directly against the inside of the undergarment shell 2 and a layer of textile fabric such as cotton or microfiber cloth is placed inside of the neoprene foam to form the padded lining 4. The neoprene foam provides some cushioning between the holstered weapon and the user's skin. The layer of textile fabric prevents skin irritation from direct contact with the neoprene foam. The padded lining 4 can be made more or less permeable to water, water vapor, and air by the choice of more open-cell or closed-cell neoprene and by the choice of textile fabric. The material used for the padded lining 4, and the method of attaching the padded lining 4 to the undergarment shell 2 and waistband 3, such as sewing, should allow for frequent and easy laundering.

Referring to FIG. 3, a holstering embodiment of the undergarment protective against carried-weapon discomfort and injury 1 of the invention provides an undergarment shell 2, a waistband 3 attached to the undergarment shell 2, and a padded lining 4 attached to the undergarment shell 2 and optionally to the waistband 3, forming an enclosed space or pocket between the undergarment shell and the protective lining which can hold a weapon, and an access opening 5 in the undergarment shell 2 providing access to the enclosed space or pocket.

The access opening 5 is placed in the undergarment shell 2 in a location corresponding to the placement of the padded lining 4, as shown. At this location, the padded lining 4 and the attached portion of the undergarment shell 2 form an enclosed space or pocket between them, with access to the pocket through the access opening 5. The access opening 5 should be placed in the upper portion of the enclosed space or pocket, and should be oriented such that the user's hand can be placed beneath any outer garment and into the access opening 5 to place or retrieve the weapon. The access opening 5 can be formed as a cut or slit in the fabric of the undergarment shell 2, with whatever finishing or treatment of the fabric edges are required, or can be formed as a larger opening in the fabric, or can be provided with a more substantial treatment of the fabric edges in order to provide improved visual or tactile identification of the access opening 5, and therefore improved access to the holstered weapon in use. A more substantial treatment of the fabric edges can include the use of piping, cord, or tape to more clearly delineate the location of the access opening 5.

Many other changes and modifications can be made in the system and method of the present invention without departing from the spirit thereof. I therefore pray that my rights to the present invention be limited only by the scope of the appended claims.

I claim:

1. An undergarment for protecting against carried-weapon discomfort and injury comprising:

(i) an undergarment shell of textile fabric, having an open top end adapted to accommodate the lower torso of a user, having two openings at a bottom end to accommodate the legs of a user, having an outside and inside surface, and having a forward and rearward portion;

(ii) a waistband attached to said undergarment shell top end, adapted to support said undergarment shell against downward slippage; and (iii) a protective panel secured inside the undergarment shell, the protective panel being formed by a flexible padded panel having a top edge secured continuously along the entire length of the top edge to the waistband, the flexible padded panel forming a pocket positioned entirely inside the undergarment shell, said protective panel configured to conceal a weapon below the waistband inside the underwear shell while providing protection against discomfort and injury from a carried weapon.

2. The undergarment for protecting against carried-weapon discomfort and injury of claim 1, where said protective panel forms an enclosed space between said undergarment shell and said flexible padded panel, said enclosed space being configured to hold a weapon.

3. The undergarment for protecting against carried-weapon discomfort and injury of claim 1, further comprising an access opening in said undergarment shell adapted to provide access by a user to a space between said undergarment shell and said protective member for placement or retrieval of a weapon.

4. The undergarment for protecting against carried-weapon discomfort and injury of claim 1, where said undergarment shell of textile fabric further comprises a textile fabric non-irritating to wearer's skin.

5. The undergarment for protecting against carried-weapon discomfort and injury of claim 1, where said undergarment shell of textile fabric further comprises a textile fabric permeable to air and water vapor.

6. The undergarment for protecting against carried-weapon discomfort and injury of claim 1, where said undergarment shell of textile fabric further comprises a textile fabric of natural fibers.

7. The undergarment for protecting against carried-weapon discomfort and injury of claim 1, where said undergarment shell of textile fabric further comprises a textile fabric of synthetic fibers.

8. The undergarment for protecting against carried-weapon discomfort and injury of claim 1, where said undergarment shell of textile fabric further comprises a textile fabric of blended natural and synthetic fibers.

9. The undergarment for protecting against carried-weapon discomfort and injury of claim 1, where said undergarment shell of textile fabric further comprises a microfiber fabric.

10. The undergarment for protecting against carried-weapon discomfort and injury of claim 1, where said waistband further comprises an elastic material.

11. The undergarment for protecting against carried-weapon discomfort and injury of claim 1, where said waistband further comprises a stretchable material.

12. The undergarment for protecting against carried-weapon discomfort and injury of claim 1, where said waistband further comprises a stretch fabric.

13. The undergarment for protecting against carried-weapon discomfort and injury of claim 1, where said flexible padded panel comprises a neoprene foam material.

14. The undergarment for protecting against carried-weapon discomfort and injury of claim 1, where said flexible padded panel comprises a textile fabric.

15. The undergarment for protecting against carried-weapon discomfort and injury of claim 1, where said flexible padded panel comprises more than one layer of material.

16. The undergarment for protecting against carried-weapon discomfort and injury of claim 1, where said flexible padded panel comprises a layer of neoprene foam material and a layer of textile fabric.

17. An undergarment for protecting against carried-weapon discomfort and injury comprising:

(i) an undergarment shell of textile fabric, having an open top end adapted to accommodate the lower torso of a user, having two openings at a bottom end to accommodate the legs of a user, having an outside and inside surface, and having a forward and rearward portion;

(ii) a waistband attached to said undergarment shell top end, adapted to support said undergarment shell against downward slippage;

(iii) a protective panel secured inside the undergarment shell, the protective panel being formed by a flexible padded panel having a top edge permanently continuously affixed along the entire length of the top edge to the waistband, said protective panel forming an enclosed space between said undergarment shell and said padded protective panel, the protective panel configured to conceal a weapon below the waistband inside the underwear shell while providing protection against discomfort and injury from a carried weapon; and (iv) an access opening in said undergarment shell adapted to provide access by a user to the enclosed space between said undergarment shell and said flexible padded panel from exterior of the undergarment shell for placement or retrieval of a weapon.

18. The undergarment for protecting against carried-weapon discomfort and injury of claim 17, where said access opening further comprises a finishing treatment adapted to provide clear delineation of the location of said access opening.

19. An undergarment protective against carried-weapon discomfort and injury method comprising:

(i) providing an undergarment for protection against carried-weapon discomfort and injury comprising:

(a) an undergarment shell of textile fabric, having an open top end adapted to accommodate the lower torso of a user, having two openings at a bottom end to accommodate the legs of a user, having an outside and inside surface, and having a forward and rearward portion;

(b) a waistband attached to said undergarment shell top end, adapted to support said undergarment shell against downward slippage; and (c) a protective panel secured inside the undergarment shell, the protective panel being formed by a flexible padded panel having a top edge secured continuously along the entire length of the top edge to the waistband, said protective member forming a pocket adapted to conceal a weapon below the waistband inside the underwear shell, while providing protection against discomfort and injury from a carried weapon; and (ii) wearing said undergarment protective against carried-weapon discomfort and injury, where the flexible padded panel forms a pocket positioned entirely inside the undergarment shell.

* * * * *